US009119451B2

(12) United States Patent
Vestweber

(10) Patent No.: US 9,119,451 B2
(45) Date of Patent: Sep. 1, 2015

(54) PAPER PLATE AND PLASTIC SANDWICH BAG INSERT AND COMBINATION

(71) Applicant: Charles Edwin Vestweber, Germantown, TN (US)

(72) Inventor: Charles Edwin Vestweber, Germantown, TN (US)

( * ) Notice: Subject to any disclaimer, the term of this patent is extended or adjusted under 35 U.S.C. 154(b) by 0 days.

(21) Appl. No.: 14/525,762

(22) Filed: Oct. 28, 2014

(65) Prior Publication Data

US 2015/0114873 A1 Apr. 30, 2015

Related U.S. Application Data

(60) Provisional application No. 61/961,961, filed on Oct. 28, 2013.

(51) Int. Cl.

| | |
|---|---|
| ***A45C 11/20*** | (2006.01) |
| ***B65D 5/56*** | (2006.01) |
| ***B65D 77/04*** | (2006.01) |
| ***B65D 5/20*** | (2006.01) |
| ***B65D 5/24*** | (2006.01) |
| ***B65D 85/36*** | (2006.01) |

(52) U.S. Cl.

CPC ..... *A45C 11/20* (2013.01); *B65D 5/2038* (2013.01); *B65D 5/24* (2013.01); *B65D 5/244* (2013.01); *B65D 5/563* (2013.01); *B65D 77/0406* (2013.01); *B65D 85/36* (2013.01)

(58) Field of Classification Search

USPC ..... 206/541, 216, 217, 218, 223, 548, 549

See application file for complete search history.

(56) References Cited

U.S. PATENT DOCUMENTS

| | | | | | |
|---|---|---|---|---|---|
| 2,584,379 | A | * | 2/1952 | Chmielewski | 206/551 |
| 3,381,882 | A | * | 5/1968 | Van Nostrand | 229/117.07 |
| 3,405,863 | A | * | 10/1968 | Kugler | 383/75 |
| 3,512,700 | A | * | 5/1970 | Evans et al. | 383/121 |
| 3,558,406 | A | * | 1/1971 | Kugler | 156/515 |
| 3,594,177 | A | * | 7/1971 | McGowan | 426/112 |
| 3,833,113 | A | | 9/1974 | Osier | |
| 3,904,104 | A | | 9/1975 | Kane | |
| 3,966,112 | A | | 6/1976 | Gordon | |
| 4,061,241 | A | | 12/1977 | Retelny | |
| 4,708,248 | A | * | 11/1987 | Davis | 206/549 |
| 4,709,851 | A | * | 12/1987 | Vanasse | 229/87.09 |
| 4,779,998 | A | * | 10/1988 | Wischusen, III | 383/121 |
| 5,062,558 | A | * | 11/1991 | Stang | 224/270 |
| 5,110,038 | A | | 5/1992 | Pantisano et al. | |
| 5,203,493 | A | * | 4/1993 | Moody | 229/103 |
| 5,328,265 | A | | 7/1994 | Clooney | |
| 5,353,984 | A | | 10/1994 | Liu et al. | |

(Continued)

FOREIGN PATENT DOCUMENTS

WO WO2011/151648 12/2011

*Primary Examiner* — Jacob K Ackun

(74) *Attorney, Agent, or Firm* — Joseph S. Heino; Patrick M. Bergin

(57) ABSTRACT

A combination in accordance with the present invention comprises two elements; an insert and a sealable plastic bag. In the preferred embodiment, the insert comprises an outer perimeter; a plurality of primary folds formed within the outer perimeter; a plurality of side supports extending outwardly from the plurality of primary folds; and a plurality of secondary corner folds at the outer perimeter. The insert is used with a pliable and portable food item, such as a sandwich, and placed within the sealable plastic bag. The insert further comprises elements to tent or protect the food item during transport of the insert and food item within the bag.

18 Claims, 2 Drawing Sheets

(56) References Cited

U.S. PATENT DOCUMENTS

| | | | | |
|---|---|---|---|---|
| 5,397,051 | A | 3/1995 | Liu et al. | |
| 5,421,508 | A | 6/1995 | Beales | |
| 5,632,379 | A | 5/1997 | Frost | |
| 5,806,981 | A * | 9/1998 | Schisler | 383/38 |
| 6,059,179 | A * | 5/2000 | Giampapa | 229/103 |
| 6,093,460 | A * | 7/2000 | Iwaya | 428/34.2 |
| 6,332,537 | B1 | 12/2001 | Usui et al. | |
| 6,401,927 | B1 | 6/2002 | Sorensen et al. | |
| 6,655,526 | B2 * | 12/2003 | Urman et al. | 206/223 |
| 6,719,140 | B1 | 4/2004 | Rinsler | |
| 6,994,131 | B2 * | 2/2006 | Dedmon | 150/106 |
| D524,112 | S | 7/2006 | Cogley | |
| 7,870,961 | B2 * | 1/2011 | Shai | 206/525 |
| 8,061,896 | B2 * | 11/2011 | Delgado | 383/4 |
| 8,186,530 | B2 | 5/2012 | Bar | |
| 8,439,215 | B2 | 5/2013 | Gartz et al. | |
| 8,490,823 | B2 | 7/2013 | Sirota et al. | |
| 8,551,545 | B2 | 10/2013 | Feldmeier et al. | |
| 8,684,260 | B2 | 4/2014 | White et al. | |
| 8,910,823 | B2 * | 12/2014 | Mesman | 220/529 |
| 2007/0134454 | A1 * | 6/2007 | Broderick | 428/34.2 |
| 2008/0015098 | A1 | 1/2008 | Littlejohn et al. | |
| 2008/0029425 | A1 | 2/2008 | Lebel et al. | |
| 2011/0215023 | A1 | 9/2011 | Archie, Jr. et al. | |
| 2011/0240722 | A1 | 10/2011 | Stromme | |
| 2013/0206615 | A1 * | 8/2013 | Metcalfe et al. | 206/216 |
| 2014/0014666 | A1 | 1/2014 | Kang et al. | |
| 2014/0262895 | A1 * | 9/2014 | Maceira | 206/449 |

* cited by examiner

PAPER PLATE AND PLASTIC SANDWICH BAG INSERT AND COMBINATION

This application claims the benefit and priority of U.S. Provisional Patent Application No. 61/961,961 filed on Oct. 28, 2013.

FIELD OF THE INVENTION

The present invention relates generally to containers and other items that are used for food storage, including plastic bags and the like. The present invention also relates generally to plates and other items of that are used to place food onto prior to consuming it. More specifically, the present invention relates to a paper plate insert and plastic sandwich bag, the combination being the paper plate insert and the plastic sandwich bag which contains the insert preferably with a pliable or portable food item, such as that of a sandwich.

BACKGROUND OF THE INVENTION

The art of plastic bags for holding food is well known. However, plastic bags are also well known for their inability to provide any rigid support for a food item placed or contained within the bag, particularly a food item that is pliable and portable. For that, one would require a more rigid container, such as a shallow plastic bowl and a sealable cover.

The art of paper plates is also well known. Paper plates, however, only serve to provide a clean and sanitary surface upon which food can be placed prior to and during consumption. While some paper plates have elevated and pleated edges to keep food contained on the plate, such plates do nothing to protect the integrity of a pliable and portable food item sitting on the plate, particularly when that pliable and portable food item is a sandwich.

What is not known in the art, is a device or combination that can be used for supporting the structure of a pliable and portable food item, such as a sandwich, within a plastic food bag prior to consumption, the same device also being used as a plate for the food item, including a sandwich, when the user is ready to consume the sandwich or other food item.

SUMMARY OF THE INVENTION

Using the multipurpose paper plate and plastic sandwich bag insert of the present invention, an individual consumer can use the same paper plate for making a sandwich or other pliable and portable food item, provide support for travel or transport of that food item, and then as a final consumption plate, all of which can be placed within a typical plastic sandwich bag. While some plastic sandwich bags of manufacture can accommodate the size of a paper plate, most do not employ means for use of a paper plate to be inserted inside such bag and for protecting the food item, preferably a sandwich, placed within them. This requires a separate method for making a sandwich or other food item, and another method for consumption, while providing no support for keeping the contents in their original condition during travel while inside the plastic sandwich bag.

The present invention provides an "end to end" multipurpose platform for the making of a sandwich or other pliable and portable food item, product protection during transport and for a ready-to-use consumption plate at the user's destination. It provides a reduction in the number of steps and amount of or time required for the overall process as well as a reduction of material waste from repetitive paper plates or alternative methods usage throughout the entire process. The novel paper plate insert that is configured in accordance with the present invention adds convenience to an everyday job of food preparation for lunch meals or travel and consumption needs.

The present invention has the benefit of neatly keeping food contents in good condition during transporting within a plastic bag, which could be a typical plastic sandwich bag. For example, when a sandwich is cut in half, such sandwich tends to shift within the bag and even be crushed. That is, an additional support for the pliable and portable food item is conducive to the final presentation and consumption or such, particularly as in the case of loose items like vegetables or fragile desert selections. This unique design is also conducive to microwaving food products as is, from inside the plastic sandwich bag. For example, microwave items include meats, tacos, burritos, French fries and chicken strips, to name only a few such food items, can be held by the insert and within the bag.

The structure of the paper plate insert in the combination of the present invention can be further enhanced with a light coating of wax to allow for multiple usages until the original structure is compromised.

The foregoing and other features of the present invention will be apparent from the detailed description that follows.

DETAILED DESCRIPTION

As a preliminary matter, it is known in the arts that pressed paperboard containers, such as disposable paper plates and bowls having increased strength and rigidity, can be formed with stamped, folded or pleated portions formed in them. This manufacturing technology is used in the formation of one element of the present invention and is incorporated herein by reference.

Figure 1:
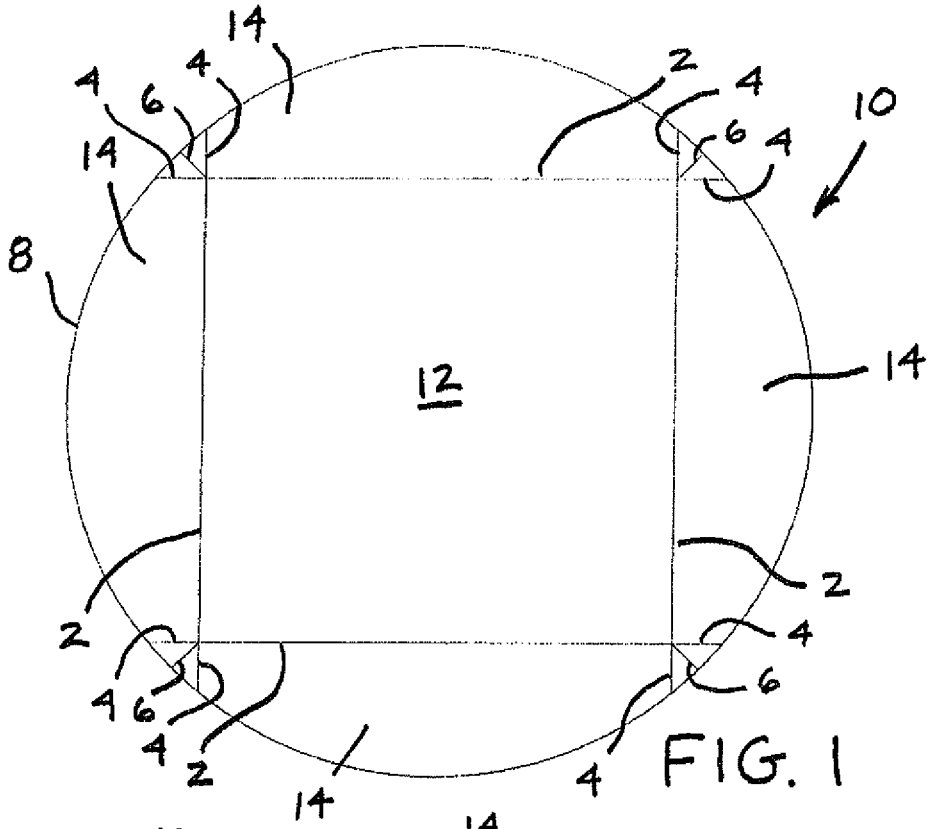
FIG. 1 is a top plan view of the paper plate insert that is constructed and configured in accordance with the present invention, the paper plate insert being shown in an unfolded state.

Referring now to the drawings in detail, wherein like numbered elements refer to like elements throughout, FIG. 1 shows a top plan view of the first "element" of the present invention, which first element is an "insert" in the form of a substantially flat paper plate insert, generally identified 10. The paper plate insert 10 comprises an outer perimeter 8, which is substantially circular in shape. The insert 10 also comprises a plurality of manufacturing stamped or pleated primary folds 2 that are formed on or within the insert 10. The plurality of primary folds 2 form a square within the outer perimeter 8 of the insert 10, the primary folds 2 circumscribing a sandwich base platform 12. The sandwich base platform 12 is symmetric on all four sides and is, in a preferred embodiment, sized to fit the dimensions of a piece of "over the counter" sandwich bread, although the present invention is not so limited.

Figure 2:
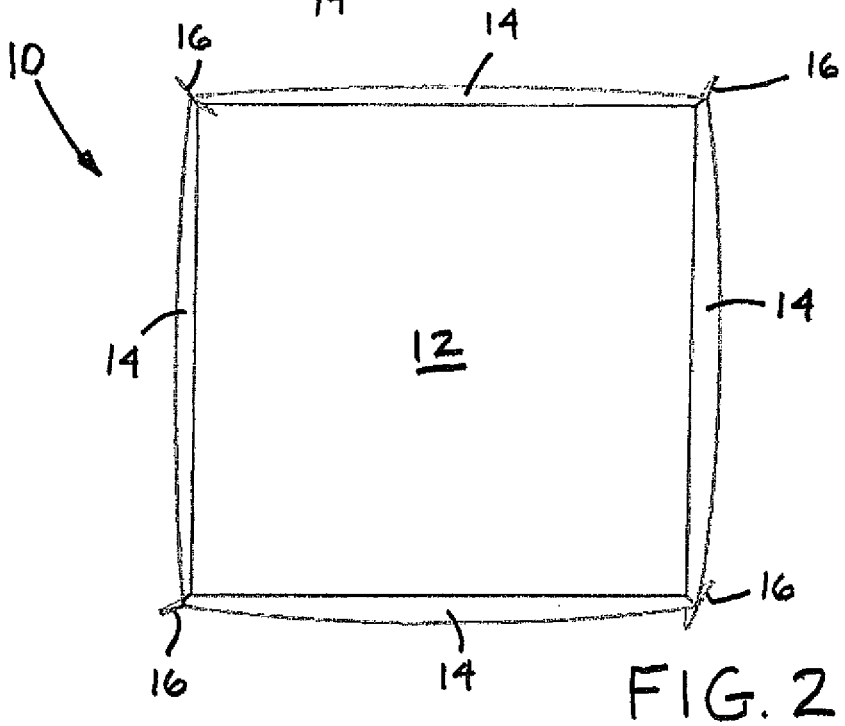
FIG. 2 is a view similar to that of FIG. 1, but showing the paper plate insert in a folded state.
Figure 3:
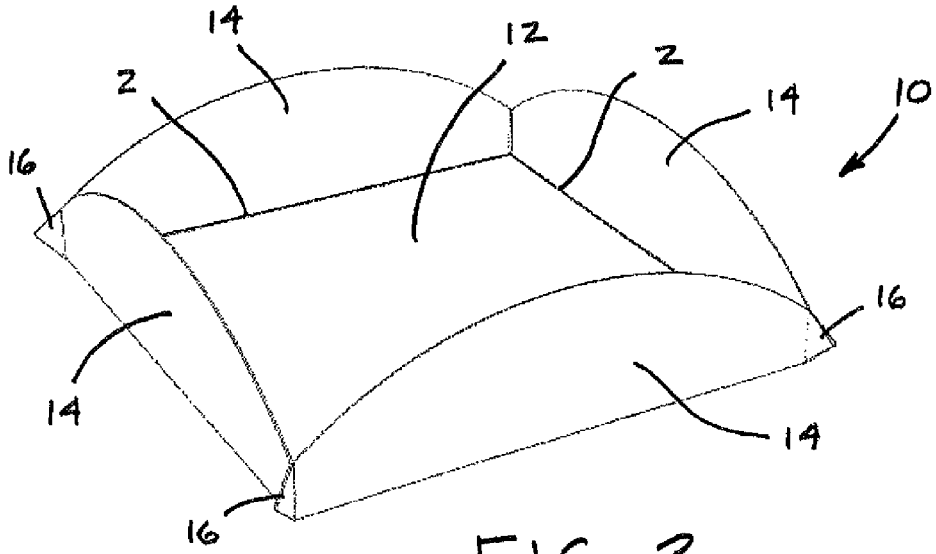
FIG. 3 is a first perspective view of the insert shown in FIG. 2.

Each of the primary folds 2 also forms one side of a plurality of side support structures 14. The support structures 14 are able to be folded upwardly from a flat horizontal position to a generally upright or near vertical position. See FIGS. 2 and 3. It is to be noted that a plurality of secondary corner folds 4, 6 is also provided. Again, see FIG. 1. By folding the outer circumference 8 of the insert 10, or more specifically, the four side support structures 14, upwardly, the plurality of secondary corner folds 4, 6 form a plurality of corner fold supports 16, which can also be considered to be sandwich bag spacers as they provide a means for "tenting" portions of the bag 20 away from the food item contain in it. See FIG. 4.

Figure 4:
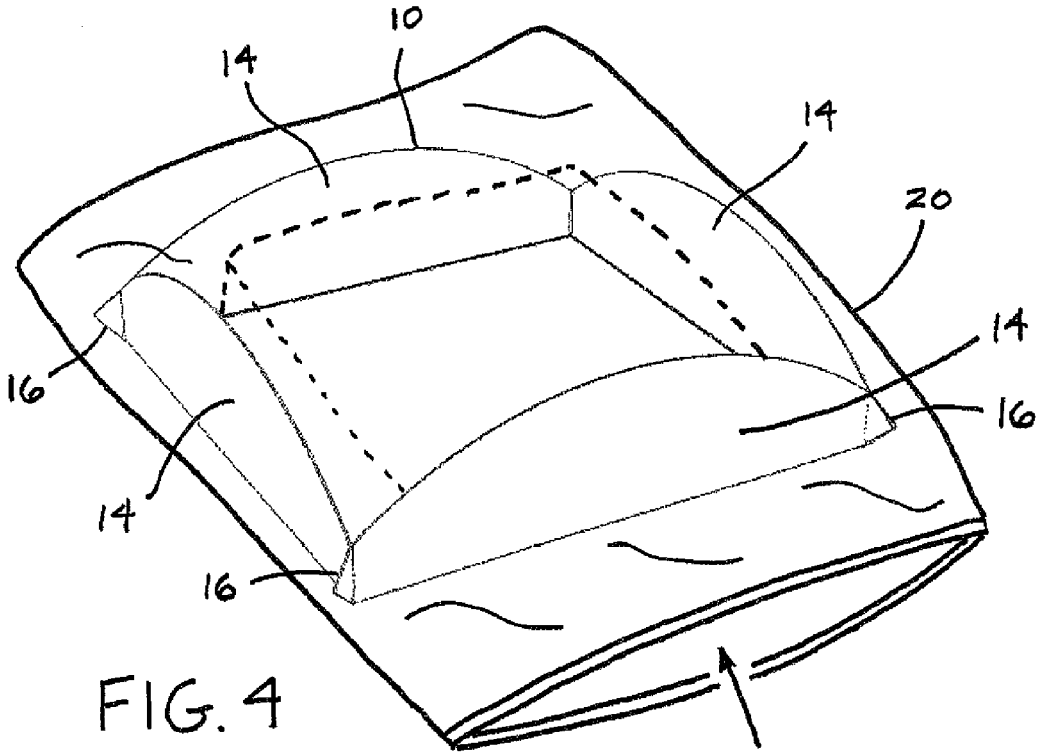
FIG. 4 is a view similar to that shown in FIG. 3 and showing the insert within a plastic bag and a sandwich shown in phantom view.

In the preferred embodiment, the paper plate insert 10 is dimensioned for best fit within the second element of the invention, which is a typical sealable plastic sandwich bag 20 for transporting an average or normal sandwich thickness ranging from peanut butter and jelly to various filler products with condiments. It is to be understood, however, that the first and second elements of the present invention could be used with any pliable and portable food item. The four corner fold supports 16 are used when the plastic sandwich bag insert 10 is in the full upright position. In this position, the plastic bag 20 is prevented from collapsing in on the food item, which is shown in FIG. 4 in phantom view. As shown, it will be appreciated that, when folded up, the side supports 14 provide additional protection for the sandwich during transportation. The four corner fold supports 16 are folded outwardly, thereby pulling the side support structures 14 closer to the contained sandwich while acting as a spacer and pushing the bag 20 outward thus creating a tighter and more taut fit. The unique stamped or folded insert 10 side support method could be replaced with paper perforations, as could all folds of the insert of the present invention. Enhanced insert side support could also be achieved through use of interlocking slots, tabs, clips or other similar methods and/or fasteners.

Further, the density and weight of the insert 10 can be changed and/or dispersed to better facilitate the insert side fold applications. Additionally, recycled materials could be used as part of a "green" alternative. Varying manufacturing composites and application materials can be used to best improve the structure and reuse ability of the overall paper plate in lieu of or in addition to a light wax application. Exact size of the sandwich base platform, side support inserts and corner fold supports may be altered for best fit. The paper plate insert and sandwich bag combination could be used for other products for transport or varied for different bag sizes as similar design concept applications are applied. This design may also have an appeal in the commercial market place.

I claim:

1. A flat paper plate insert comprising:

a round outer perimeter;

four straight primary folds formed within the outer perimeter of the insert, the straight primary folds comprising a first pair of straight primary folds and a second pair of straight primary folds, the folds of the first pair of straight primary folds being parallel to one another, the folds of the second pair of straight primary folds being parallel to one another, the folds of the first pair of straight primary folds being perpendicular to the folds of the second pair of straight primary folds, and the folds of the first pair of straight primary folds intersecting the folds of the second pair of straight primary folds;

an arcuate side support extending outwardly from each of the straight primary folds; and four secondary corner folds disposed at the outer perimeter of the insert, each secondary corner fold being disposed at each point of intersection of the straight primary folds.

2. The insert of claim 1 wherein the intersection of the folds of the first pair of straight primary folds with the folds of the second pair of straight primary folds thereby forms a square within the round outer perimeter.

3. The insert of claim 1 wherein the four secondary corner folds form four corner fold supports.

4. The insert of claim 1 wherein the side supports are disposed in a substantially upright position.

5. The insert of claim 1 wherein the four straight primary folds are formed by perforations made in the insert.

6. The insert of claim 1 wherein the insert comprises a recycled paper product.

7. The insert of claim 1 wherein the insert comprises a wax coated paper product.

8. The insert of claim 2 wherein the square circumscribes a sandwich base platform.

9. The insert of claim 8 wherein the platform is adapted to be a preparation surface, a carrying surface and an eating surface for a food product placed thereon.

10. A combination comprising:

an insert comprising a round outer perimeter; four straight primary folds formed within the outer perimeter of the insert, the straight primary folds comprising a first pair of straight primary folds and a second pair of straight primary folds, the folds of the first pair of straight primary folds being parallel to one another, the folds of the second pair of straight primary folds being parallel to one another, the folds of the first pair of straight primary folds being perpendicular to the folds of the second pair of straight primary folds, and the folds of the first pair of straight primary folds intersecting the folds of the second pair of straight primary folds; an arcuate side support extending outwardly from each of the straight primary folds; and four secondary corner folds disposed at the outer perimeter of the insert, each secondary corner fold being disposed at each point of intersection of the straight primary folds; and a sealable plastic bag;

wherein the insert is placed within the bag.

11. The combination of claim 10 wherein the intersection of the folds of the first pair of straight primary folds with the folds of the second pair of straight primary folds thereby forms a square within the round outer perimeter.

12. The combination of claim 10 wherein the four secondary corner folds of the insert form four corner fold supports.

13. The combination of claim 10 wherein the side supports of the insert are disposed in a substantially upright position.

14. The combination of claim 10 wherein the insert comprises a recycled paper product.

15. The combination of claim 10 wherein the insert comprises a wax coated paper product.

16. The combination of claim 10 wherein the sealable plastic bag is a sandwich bag.

17. The combination of claim 10 wherein the folds are formed by perforations made in the insert.

18. The combination of claim 11 wherein the square circumscribes a sandwich base platform.

* * * * *